US011386738B1

(12) United States Patent
Takashima

(10) Patent No.: US 11,386,738 B1
(45) Date of Patent: Jul. 12, 2022

(54) AUTOMATED TELLER MACHINE

(71) Applicant: GLORY LTD., Himeji (JP)

(72) Inventor: Eita Takashima, Himeji (JP)

(73) Assignee: GLORY LTD., Himeji (JP)

( * ) Notice: Subject to any disclaimer, the term of this patent is extended or adjusted under 35 U.S.C. 154(b) by 0 days.

(21) Appl. No.: 17/201,379

(22) Filed: Mar. 15, 2021

(51) Int. Cl.

| | |
|---|---|
| ***G06Q 40/00*** | (2012.01) |
| ***G07D 11/00*** | (2019.01) |
| ***G07F 19/00*** | (2006.01) |
| ***G07D 11/18*** | (2019.01) |
| ***G07D 11/14*** | (2019.01) |
| ***G07D 11/60*** | (2019.01) |
| ***G07D 11/40*** | (2019.01) |
| ***G07D 11/22*** | (2019.01) |

(52) U.S. Cl.
CPC ..... *G07D 11/18* (2019.01); *G07D 11/009* (2013.01); *G07D 11/14* (2019.01); *G07D 11/22* (2019.01); *G07D 11/40* (2019.01); *G07D 11/60* (2019.01); *G07F 19/202* (2013.01); *G07F 19/205* (2013.01)

(58) Field of Classification Search
CPC ..... G07D 11/18; G07D 11/009; G07D 11/14; G07D 11/22; G07D 11/40; G07D 11/60; G07F 19/202; G07F 19/205
USPC ..... 235/379
See application file for complete search history.

(56) References Cited

U.S. PATENT DOCUMENTS

| | | | | |
|---|---|---|---|---|
| 6,591,765 | B2 * | 7/2003 | Braddock | E05B 65/46 109/2 |
| 7,299,977 | B2 * | 11/2007 | Eastman | G06Q 20/1085 235/379 |
| 9,290,927 | B1 * | 3/2016 | Sheley | E04H 1/06 |
| 9,881,464 | B2 | 1/2018 | Jones et al. | |
| 2004/0256450 | A1 * | 12/2004 | Fujioka | G07D 11/25 235/379 |
| 2007/0023988 | A1 * | 2/2007 | Abe | G07D 11/14 271/3.01 |
| 2012/0313493 | A1 * | 12/2012 | Yokote | B65H 29/006 312/186 |
| 2016/0335614 | A1 * | 11/2016 | Norota | G06Q 20/1085 |
| 2017/0309133 | A1 * | 10/2017 | Okamoto | B65H 31/24 |

* cited by examiner

*Primary Examiner* — Tuyen K Vo
(74) *Attorney, Agent, or Firm* — Lex IP Meister, PLLC

(57) ABSTRACT

The automated teller machine that conducts transactions by a customer operation is provided. The automated teller machine comprises a customer service part configured to receive customer operations; an input pocket; a media recognizer configured to recognize the medium; a first storage storing the medium; a discharge pocket configured to place the medium delivered from the first storage so that the customer can take the medium out; a first transport path that connect the input pocket, the media recognizer, the first storage, and the discharge pocket to transport the medium; a second storage storing a collected medium that is forgotten to be taken out from the discharge pocket by the customer; and a second transport path connecting the second storage to the first transport path, wherein the second storage is arranged above the first transport paths and on an opposite side of the customer service part.

14 Claims, 14 Drawing Sheets

FIG. 12

Unlock authority of clerks

| Clerk ID | Password | 1st lock | 2nd lock | 3rd lock |
|---|---|---|---|---|
| 1 | □□□□ | ○ | ○ | ○ |
| 2 | △△△△ | ○ | × | × |
| 3 | ×××× | ○ | ○ | × |
| ⋮ | ⋮ | ⋮ | ⋮ | ⋮ |

AUTOMATED TELLER MACHINE

TECHNICAL FIELD

The present disclosure relates to an Automated Teller Machine (ATM) that dispenses media.

BACKGROUND

Conventionally, in the lobby of a financial institution such as a bank, an automated teller machine capable of conducting a transaction by the customer's own operation is installed (see, for example, U.S. Pat. No. 9,881,464)

In this type of conventional automated teller machine, a safe is provided inside the housing of the automated teller machine. In the deposit process, banknotes inserted into the input pocket from the outside are stored in the safe, and in the withdrawal process, a specified amount of the banknotes stored in the safe are taken from the safe to the discharge pocket. The banknotes delivered to the discharge pocket are held in the discharge pocket, and the customer can take out the banknotes held in the discharge pocket.

In addition, the automated teller machine is equipped with a retract/reject bin that pulls in and stores banknotes which have been forgotten by the customer to take out from the discharge pocket in the withdrawal process, thereby preventing the forgotten banknotes from being taken away illegally.

U.S. Pat. No. 9,881,464 discloses a retract/reject bin which is located in the safe of the automated teller machine. The safe is located at the bottom of the automated teller machine. Therefore, when a bank clerk collects the forgotten banknote from the retract/reject bin, the clerk has to take an uncomfortable posture such as bending over to open the door of the safe.

SUMMARY

The present disclosure is made in consideration of the above points and provides an automated teller machine that allows a financial institution clerk easy access to the forgotten banknotes. The automated teller machine that conducts transactions by a customer operation is provided. The automatic teller machine comprises a customer service part configured to receive customer operations; an input pocket provided in the customer service part and configured to receive a medium input by a customer; a media recognizer configured to recognize the medium received by the input pocket; a first storage storing the medium recognized by the media recognizer; a discharge pocket provided in the customer service part and configured to discharge the medium to an outside of the automatic teller machine; a first transport path that connect the input pocket, the media recognizer, the first storage, and the discharge pocket to transport the medium; a second storage storing a collected medium, wherein the collected medium is the medium forgotten to be taken out from the discharge pocket by the customer; and a second transport path connecting the second storage to the first transport path, wherein the second storage is arranged above the first transport paths and on an opposite side of the customer service part.

BRIEF DESCRIPTION OF THE DRAWINGS

FIG. 12 is an example table of unlock authority of clerks.

DETAILED DESCRIPTION

Figure 1:
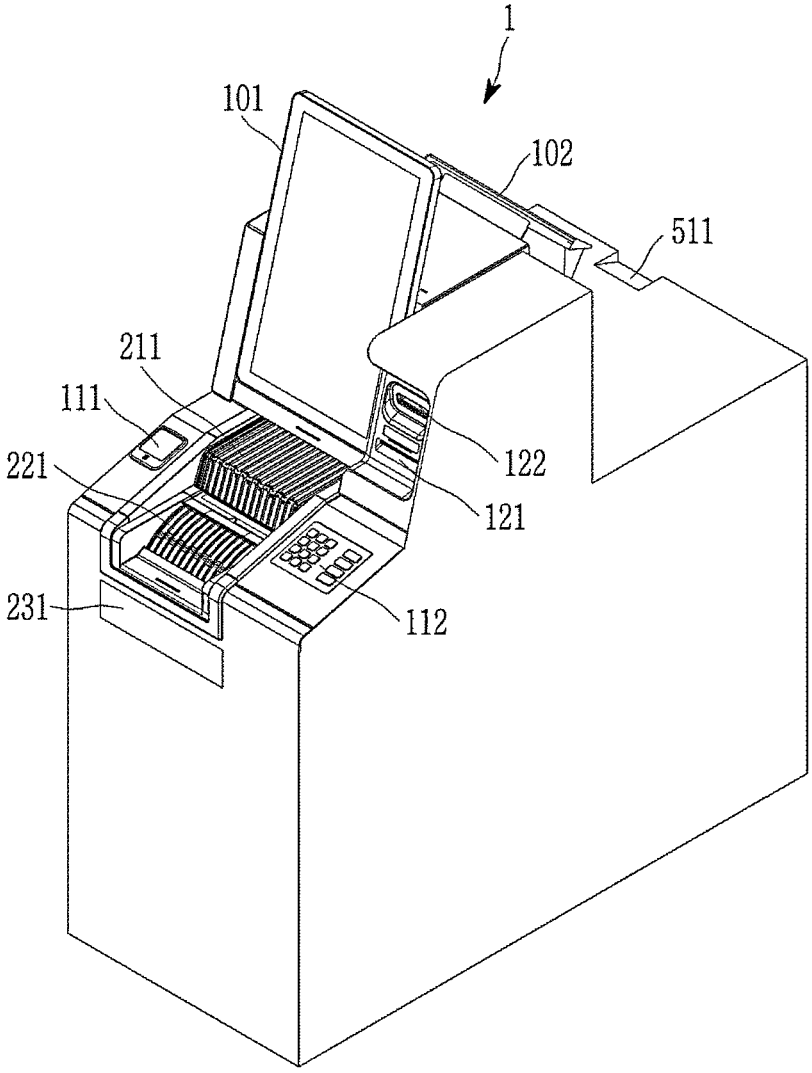
FIG. 1 is a perspective view illustrating an appearance of an automated teller machine according to an example embodiment.

The present disclosure will be described more fully hereinafter with reference to the accompanying drawings, in which embodiments of the disclosure are shown. As those skilled in the art would realize, the described embodiments may be modified in various different ways, all without departing from the spirit or scope of the present.

In order to clearly describe the present disclosure, parts that are irrelevant to the description may be omitted, and identical or similar constituent elements throughout the specification are denoted by the same reference numerals.

Further, in the drawings, the size of each element is arbitrarily illustrated for ease of description, and the present disclosure is not necessarily limited to those illustrated in the drawings.

The term "media", as used herein, is to include currency, checks, bills, receipts, tickets, paper, and/or any other type of media that may be used with an automated teller machine.

The term "controller", as used herein, any piece of or portion of hardware, or software, or any piece or portion of logic, or a combination thereof. The piece or portion of hardware may be one or more circuitries. The piece or portion of hardware may include at least a processor and a portion of memory, and the memory includes an instruction to execute. The term "component", as used herein, is generally any piece or portion of hardware of the automated teller machine that, wholly or in part, performs a function of the automated teller machine.

Further, it should be noted that certain terms used herein, such as "upper", "lower", "middle", "upward", "downward", "top", "bottom", "front", "rear", "side", and the like, are used to facilitate the description of the embodiment(s)

illustrated in the accompanying figures. Unless otherwise specified or made apparent by the context of the discussion, such terms should be interpreted as intended merely to facilitate the description of the features under discussion. Such terms are not intended as a limitation on the orientation in which components exist or may be used.

Figure 2:
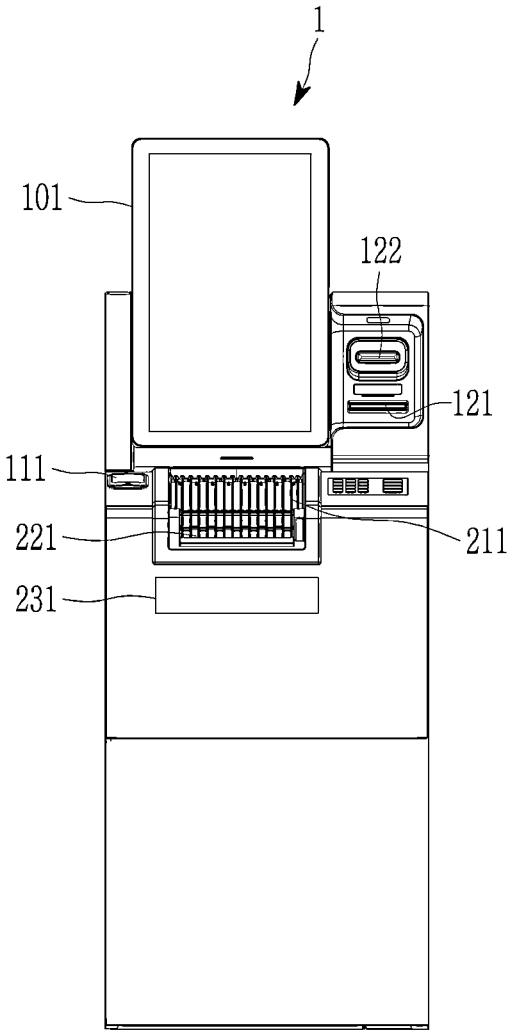
FIG. 2 is a front view of the automated teller machine shown in FIG. 1.
Figure 3:
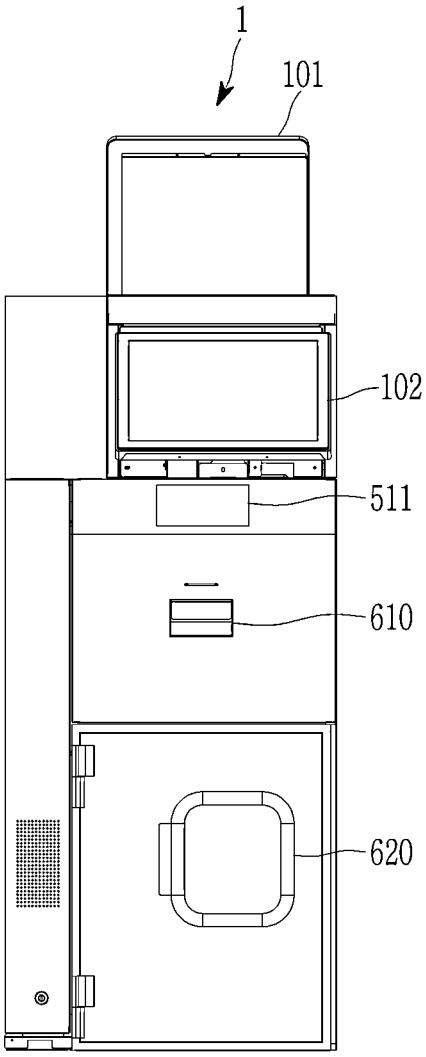
FIG. 3 is a rear view of the automated teller machine shown in FIG. 1.
Figure 4:
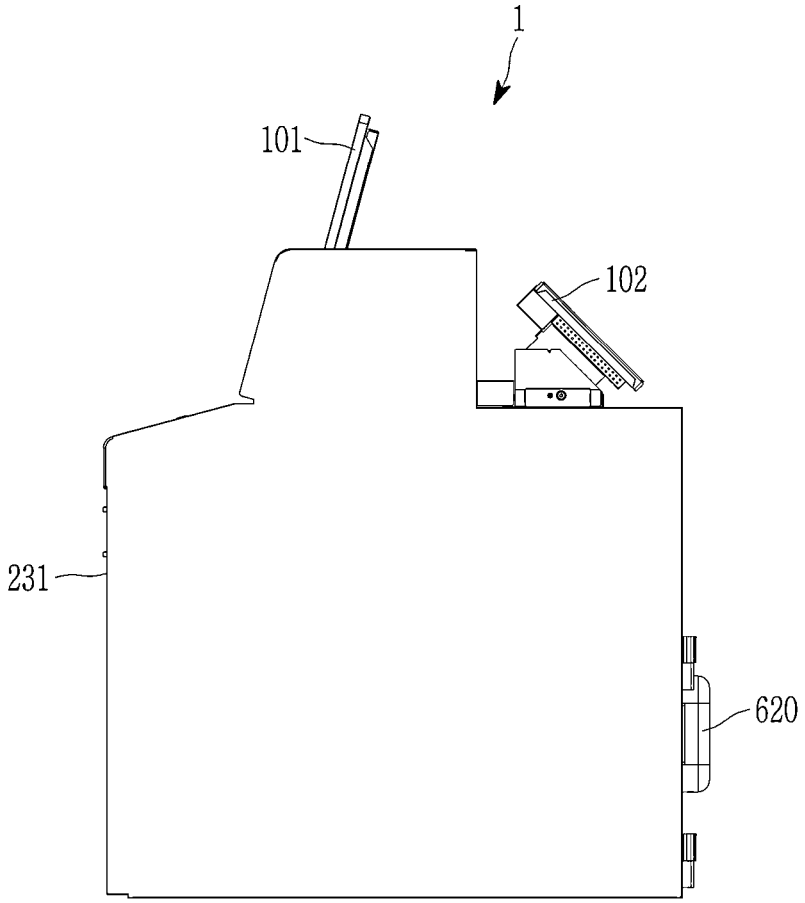
FIG. 4 is a side view of the automated teller machine shown in FIG. 1.
Figure 5:
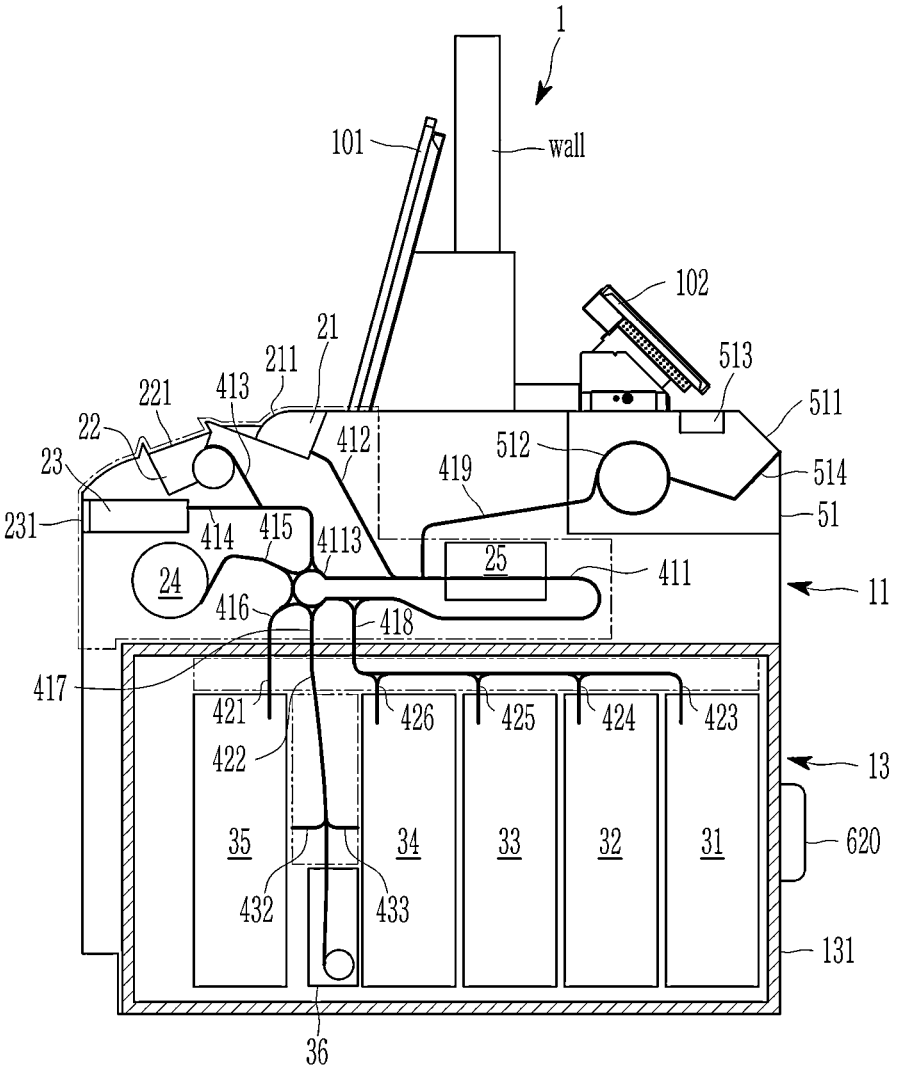
FIG. 5 is a schematic diagram showing an example internal configuration of the automated teller machine shown in FIG. 1.

FIG. 1 is a perspective view illustrating an appearance of an Automated Teller Machine (ATM) 1 according to an example embodiment. FIG. 2 is a front view of the automated teller machine 1 shown in FIG. 1. FIG. 3 is a rear view of the automated teller machine 1 shown in FIG. 1. FIG. 4 is a side view of the automated teller machine 1 shown in FIG. 1. FIG. 5 is a schematic diagram showing an example internal configuration of the automated teller machine 1 shown in FIG. 1.

The automated teller machine 1 is usually installed in the lobby of a financial institution such as a bank, and is operated by a customer himself/herself. Automated teller machine 1 is an automated device that can dispense media, receive media, communicate with the financial institution, and communicate with the customer, among others. It is to be appreciated and understood that the automated teller machine 1 may be a stand-alone unit, partly incorporated into a structure (e.g., interior wall, exterior wall, and the like).

Referring to FIGS. 1-5, the automated teller machine 1 includes a customer service part (front part) provided with a customer screen 101 operated by the customer and an institution clerk part (rear part) disposed on the opposite side of the customer service part and provided with a clerk screen 102, which is operated by the clerk of the financial institution. The customer service part and the institution clerk part are separated by a wall. The customer service part is disposed in the front side and the institution clerk part is disposed in the rear side.

The customer service part is provided with an input pocket 21 with a shutter 211 for inserting a medium such as a banknote and a discharge pocket 22 with a shutter 221 for discharging the medium, but the input pocket 21 and the discharge pocket 22 may be unified. The customer service part is provided with a rejection pocket 23 with a shutter 231 for discharging a medium which cannot be authenticated, but the rejection pocket 23 may be absent and of which function may be substituted by the input pocket 21 or the discharge pocket 22. The customer service part may be provided with an NFC leader 111, a numeric keypad (PIN pad) 112, a receipt outlet 121, and a card slot 122, among others.

The institution clerk part is provided with a collector 51 having a collection pocket 514 as the second storage and a shutter 511. The collector 51 collects and stores the medium that the customer has forgotten to take out from the discharge pocket 22. The institution clerk part may be provided with a pulling handle 610 and a cover 620. The cover 620 covers a lever with a key pad or a dial. The clerk uses the pulling handle 610 to pull out an upper unit 11 of the automated teller machine 1. The clerk uses the lever to open the safe door 131 of the automated teller machine 1.

As shown in FIG. 5, the automated teller machine 1 is provided with a transporter including pluralities of transport paths 411, 412, 413, 414, 415, 416, 417, 418, 419, 4113, 421, 422, 423, 431, 432, and 433. The transporter transports the medium to a media analyzer 25, a temporary storage 24, and storage divisions 31, 32, 33, 34, 35, and 36 as the first storages. The storage divisions are disposed in a safe 13 for storing the medium. The media recognizer 25 is intended to include any component in the automated teller machine 1 where the medium is recognized for authenticity, quality, denomination, number of document(s), or any other characteristic of the medium. The recognition may be performed by capturing an image of at least one part of the media, capturing and evaluating an indicia on the media, capturing a video of the portion of the media, scanning a serial number, identifying an indicia on the media, and/or a combination thereof. The transporter includes a plurality of rollers, belts, driving motors, and guides to constitute the transport paths 411, 412, 413, 414, 415, 416, 417, 418, 419, 4113, 421, 422, 423, 431, 432, and 433.

The automated teller machine 1 includes the upper unit 11 and a lower unit where the safe 13 is installed. The media recognizer 25, the temporary storage 24, the collector 51 are provided in the upper unit 11. The transport paths 411, 412, 413, 414, 415, 416, 417, 418, 419, 4113, 421, 422, 423, 431, 432, and 433 are distributed in the upper unit 11 and the lower unit. The transport paths include the first transport path. The first transport path 411, 412, 413, 416, 418 connect the input pocket 21, the media recognizer 25, the first storages 31, 32, 33, 34, 35, 36, and the discharge pocket 22 to transport the medium. The transport paths include the second transport path 419. The second transport path 419 connects the second storage 514 to the first transport path 411, 412, 413, 416, 418.

The first transport path has a circulation path 411 passing through the media recognizer 25. The circulation path 411 is connected to the transport paths 412, 413, and the second transport path 419. The transport paths 412 is connected to the input pocket 21. The transport paths 413 is connected to the discharge pocket 22. The second transport paths 419 is connected to the second storage 514 of the collector 51. Accordingly, the same circulation path 411 is used for all operations of inputting, discharging, and collecting. The transport paths 411, 412, 413, 414, 415, 416, 417, 418, 419, 4113, 421, 422, 423, 431, 432, and 433 may be a horizontal transport path, a vertical transport path, or an oblique transport path. By making it horizontal, the medium input from customer service part is able to be transported to the institution clerk part on the opposite side with respect to the wall. Especially the first transport path has the third transport path arranged horizontally. The third transport path is a part of the circulation path 411. The recognizer 25 is on the third transport path. The second storage 514 is arranged above the third transport path.

The second storage 514 of the collector 51 is connected to the second transport path 419. The second transport path 419 branches upward from the circulation path 411 that connects the input pocket 21 or the discharge pocket 22 and the media recognizer 25. So the second storage 514 of the collector 51 is located upper portion of the automated teller machine 1. In other words, the second storage 514 of the collector 51 is connected to the input pocket 21, the media recognizer 25, and the discharge pocket 22 and located above the second transport path 419 and the circulation path 411 that transport the medium. Further, the route from the discharge pocket 22 to the collector 51 may be formed not to pass the media recognizer 25. That is, the location of the collector 51 may be above the transport paths 411 and 412 from the input pocket 21 to the media recognizer 25. The collector 51 is disposed in the upper unit 11 and the institution clerk part of the automated teller machine 1. Referring to FIG. 5, the collector 51 is disposed at the upper-left corner of the automated teller machine 1. As a result, the collector 51 is installed at a height at which a clerk does not have to bend down, so that the clerk can easily access the second storage 514 of the collector 51. In addition, the clerk can quickly access the second storage 514 of the collector 51 when necessary without having to open the safe door 131.

The height of the second storage 514 is set to a height conforming to the American with Disabilities Act (ADA). In other words, the height of the second storage 514 is set to a height conforming to ADA. Or the height of the shutter 511 is set to a height conforming to ADA. The specific height is 48 inches or less and 15 inches or more from the bottom of the automated teller machine 1. Accordingly, even a staff member using a wheelchair may easily collect the medium that the customer has forgotten to take. The input and discharge pockets are also arranged at a height that complies with the ADA.

Figure 6:
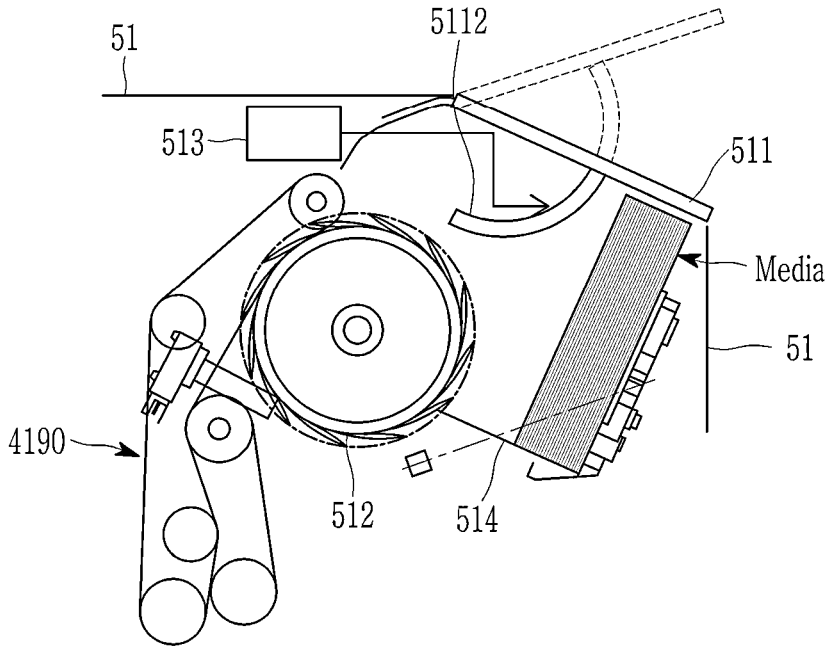
FIG. 6 is a schematic diagram showing an example internal configuration of a collection unit.

As shown in FIG. 6, the collector 51 includes the collection pocket 514 as the second storage, the shutter 511, an impeller 512, and an actuator 513 for opening and closing the shutter 511. The impeller 512 is connected to the second transport path 419 to receive the forgotten medium and put it into the collection pocket 514. The second transport path 419 is formed by transport mechanism 4190 including a plurality of rollers, belts, driving motors, and guides. The shutter 511 is driven to open and close by the actuator 513 through a linking mechanism 5112.

The collection pocket 514 of the collector 51 has an opening facing upward, and thereby preventing the collected media from falling down to the floor when the shutter 51 is open. In addition, since the collection pocket 514 as the second storage is provided on a middle part of the institution clerk part, of which opening to face the rear side of the automated teller machine 1, that is, the opposite side of the customer service part, the clerk may insert his/her hand into the collection pocket 514 in a natural posture and easily collect the media from the collection pocket 514.

Here, if it is desired to limit the persons who can access the collector 51 as the second storage, a lock may be provided on the shutter 511. The lock may be unlocked by inputting an unlock command through the clerk screen 102 provided on the institution clerk part of the automated teller machine 1. As a result, the shutter 511 of the collector 51 can be unlocked only by operating the clerk screen 102. Further, the unlock command may be input from an external personal computer or the like. Accordingly, the lock can be unlocked without directly operating the clerk screen 102 of the automated teller machine 1. Further, the lock may be automatically unlocked in the process of error release or maintenance work, or a mechanism for unlocking with a key may be applied. Further, as described above, since the clerk screen 102 is provided on the rear surface of the automated teller machine 1, unlocking the shutter 511 of the collector 51 and collection of the media in the collector 51 can be performed at the same place.

As shown in FIG. 5, in the foregoing embodiment, since the customer service part and the institution clerk part are separated by a wall and the customer cannot access to the institution clerk part, a shield such as the shutter 511 may not be installed on the collection pocket 514. As a result, a clerk can quickly collect the forgotten medium. However, the shutter 511 may be installed for preventing the collected media from falling down to the floor even if the wall separates the institution clerk part from the customer service part.

Figure 7:
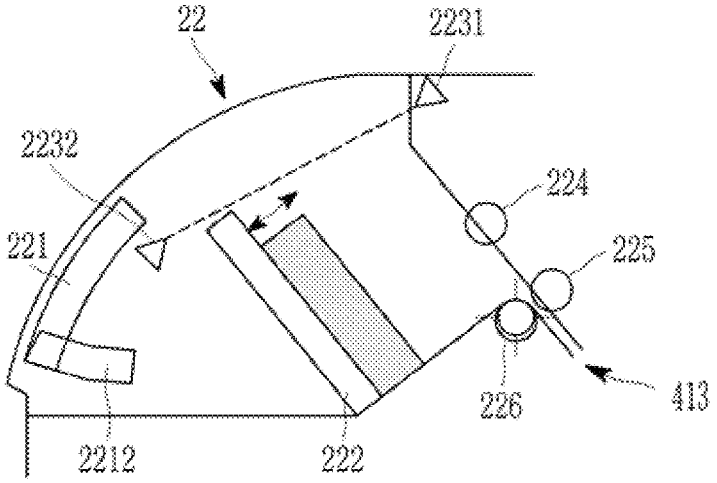
FIG. 7 is a schematic diagram showing a foldable shutter open state of a discharge unit.
Figure 8:
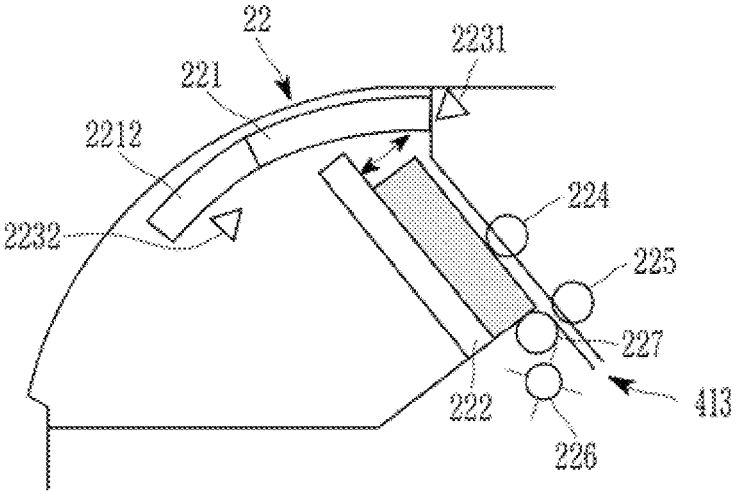
FIG. 8 is a schematic diagram showing a foldable shutter closed state of the discharge unit.

FIG. 7 is a schematic diagram showing a foldable shutter open state of a discharge unit, and FIG. 8 is a schematic diagram showing a foldable shutter closed state of the discharge unit.

As shown in FIGS. 7 and 8, a foldable shutter 221 may be provided at the opening of the discharge pocket 22. The foldable shutter 221, as shown in FIG. 8, is folded when it is open, and the lower part 2212 of the foldable shutter 221 slides toward the stage 222 when it is being folded. A sensor system 2231 and 2232 may be installed to detect the insertion of a hand into the discharge pocket 22. The sensor system 2231 and 2232 uses, for example, a transmissive optical sensor. In addition, a stage 222 that slides back and forth may be provided in the discharge pocket 22. The media conveyed through the withdrawal transport path 413 are sent into the discharge pocket 22 by a feed roller 225 and a gate roller 227, and the rear end of the media is pressed toward the stage 222 by a bill tapping roller 226. At the time of collection, the stage 222 moves toward the side of the withdrawal transport path 413 and pushes the media against the kick roller 224. The kick roller 224 kicks the abutting medium toward the withdrawal transport path 413. The feed roller 225 and the gate roller 227 send out the media and block the medium on the gate roller 227 side when two media are simultaneously sent out, at which time the gate roller stops rotating.

The shutter 221 of the discharge pocket 22 keeps closed during standby and opens when the withdrawal is performed. The withdrawal motion of the customer may be checked with a motion sensor, etc., and the shutter 221 may be set to be closed when the withdrawal motion is completed or a set time is over (forgot to withdraw). If some media is left behind in the discharge pocket 22 after the shutter 221 closed, the left media are confirmed to be forgotten to take and transported to the collector 51.

Figure 9:
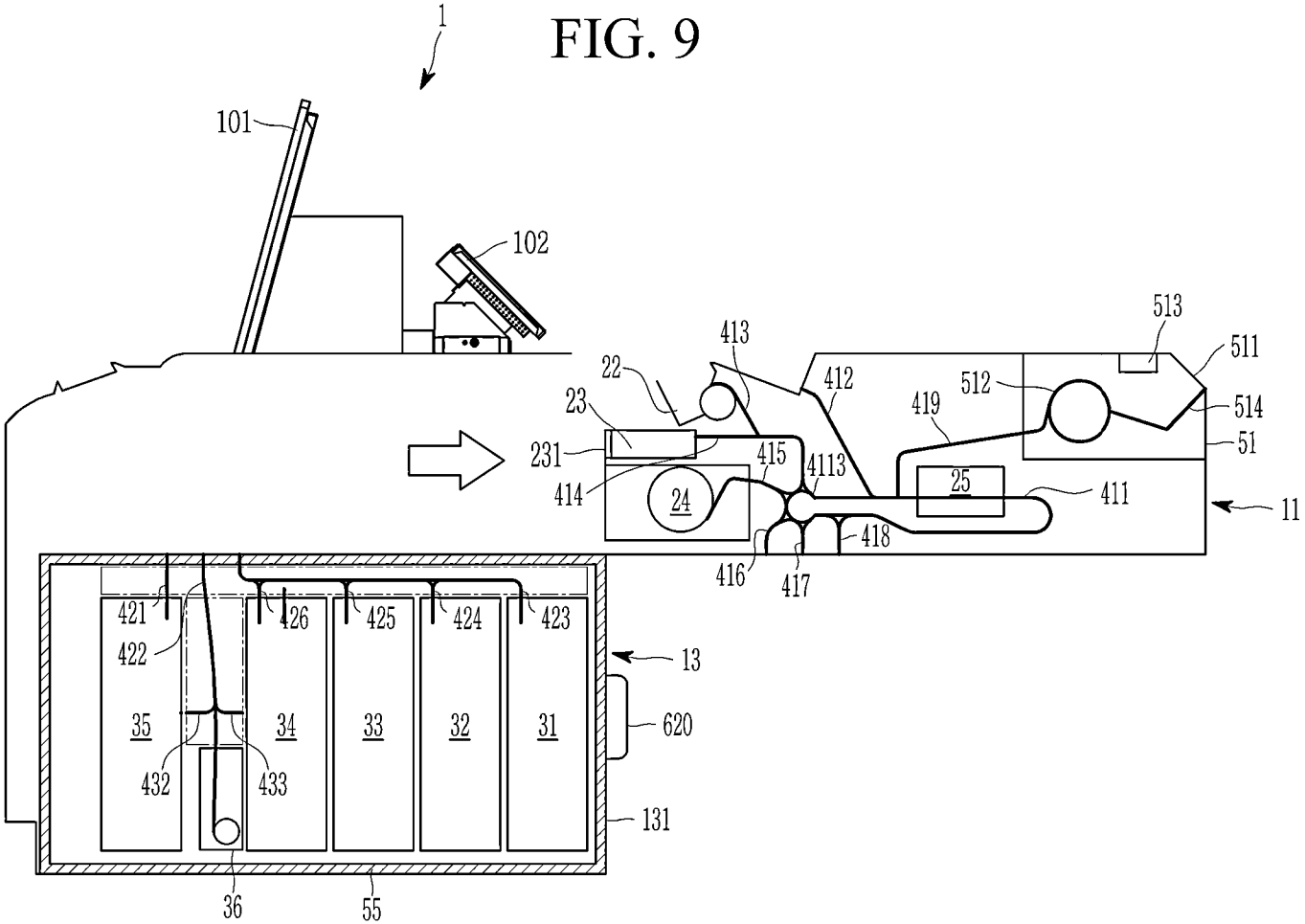
FIG. 9 is a schematic diagram showing an upper part pulled out state of the automated teller machine shown in FIG. 5.

As shown in FIG. 9, the upper unit 11 may be pulled out to the rear side of the automated teller machine 1 for maintenance or other purpose. For pulling out the upper unit 11, it is necessary to unlock a lock by operating from the clerk screen 102. In this case, the lock of the upper unit 11 is different from the lock of the shutter 511 of the collector 51 described above and the lock of the lower unit which will be described later, and the upper unit 11 may be unlocked independently. As a result, only the upper unit 11 may be pulled out for maintenance or the like, and it is not necessary to unlock unnecessary parts. In addition, since it is possible to limit the persons who can unlock the upper unit 11, security can be enhanced.

Figure 10:
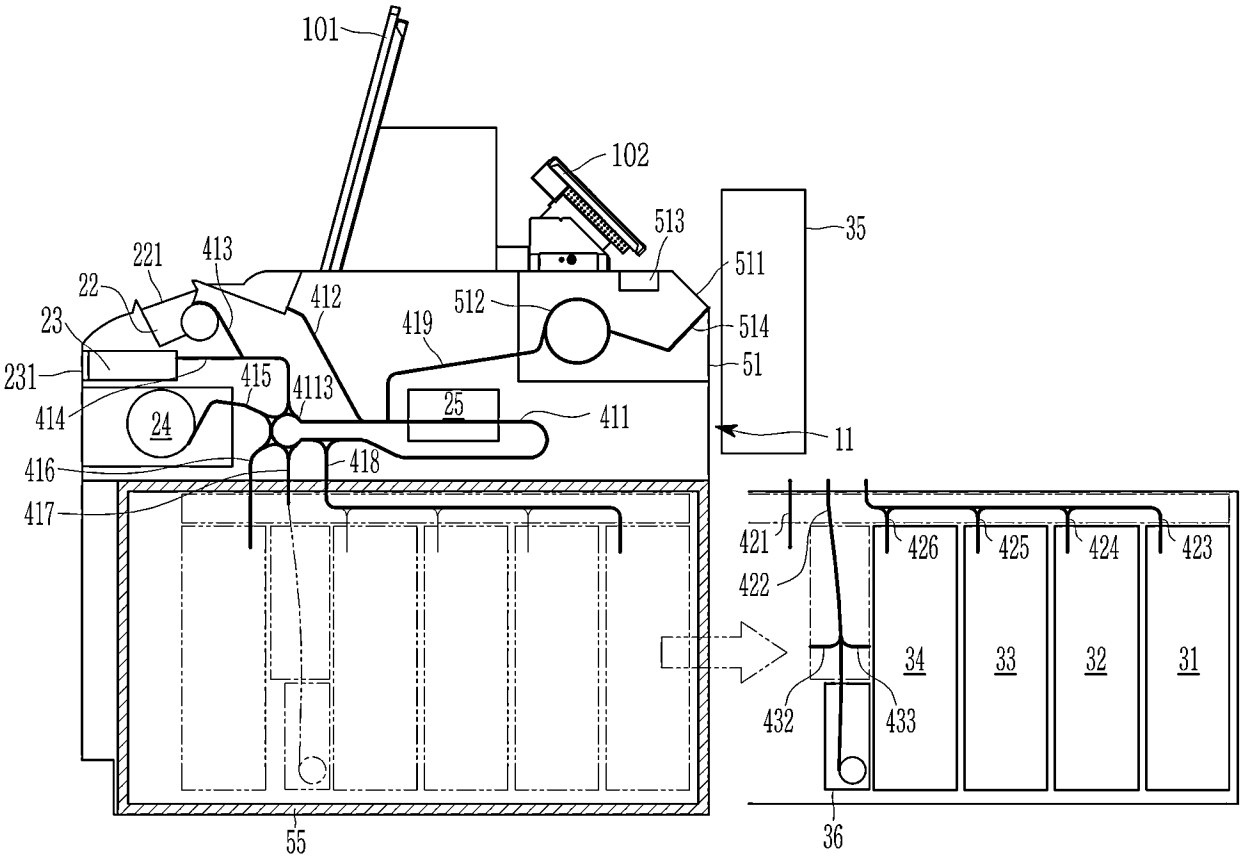
FIG. 10 is a schematic diagram showing a lower part pulled out state of the automated teller machine shown in FIG. 5.

As shown in FIG. 10, the lower unit in which the storage divisions 31, 32, 33, 34, 35, and 36 are accommodated may be pulled out to the rear side of the automated teller machine 1, for maintenance or other purpose. For pulling out the lower unit, it is necessary to unlock a lock of the safe door 131 by operating from the clerk screen 102. In this case, the lock of the safe door 131 is different from the lock of the shutter 511 of the collector 51 and the lock of the upper unit 11 described above, and the safe door 131 may be unlocked independently. As a result, only the lower unit may be pulled out for maintenance or the like, and it is not necessary to unlock unnecessary parts. It is also possible to limit the person who can unlock the safe door 131 of the safe 13 only to authorized persons, and therefore security can be enhanced.

Figure 11:
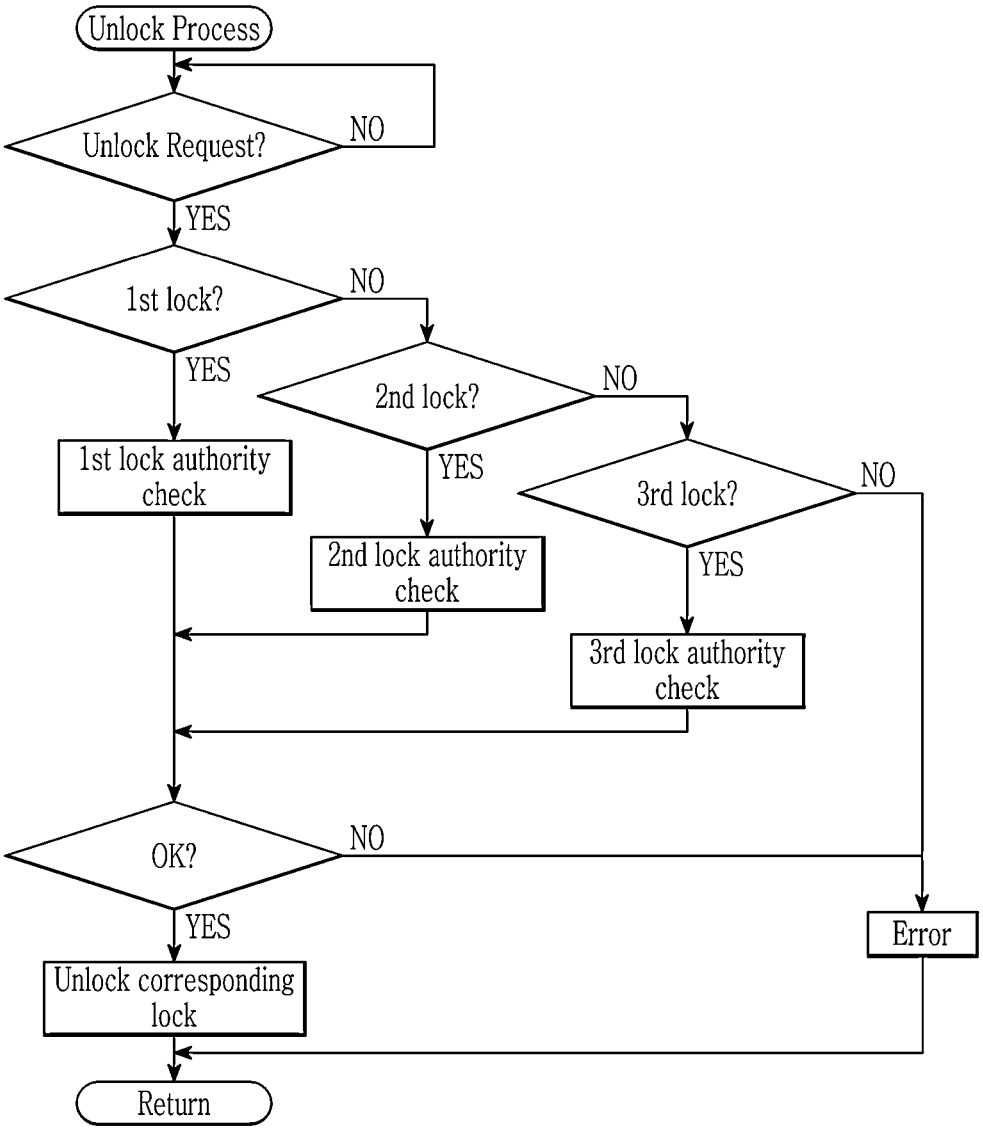
FIG. 11 is a flowchart of unlock process of locks installed in an automated teller machine according to an example embodiment.
Figure 13:
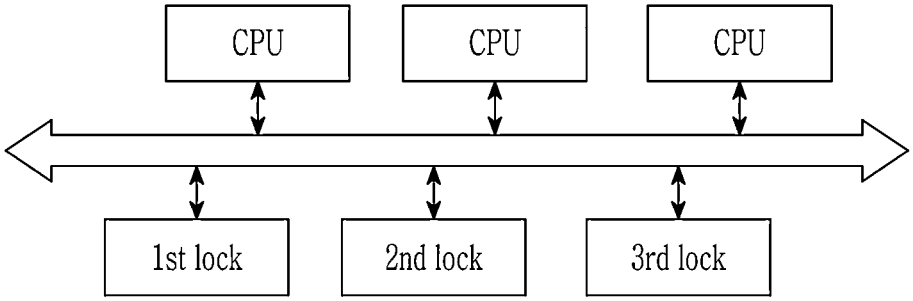
FIG. 13 is an example process of controlling locks of an automated teller machine.

Regarding the unlock process, as shown in FIGS. 11, 12, and 13, a controller of the automated teller machine 1 or a personal computer (PC) connected to the automated teller machine 1 controls each of the locks (a first lock, a second lock, a third lock). The authority for unlocking each of the locks is stored in a memory such as a Random Access Memory (RAM) or the like of the controller as shown in the table of FIG. 12 and referred to in the unlock process shown in FIG. 11.

The table of FIG. 12 stores the ID and password of the institution clerk and the availability of the unlocking authority for each of the locks. In FIG. 12, the "o" mark means that the unlocking authority is available, and the "x" mark means that the unlocking authority is not available. The controller, for example a central processing unit (CPU), confirms the unlocking authority of the operator (institution clerk) who has input the unlock request by executing the unlock process of FIG. 11 stored in a Read Only Memory (ROM). In the unlocking authority check process, the availability of the unlocking authority is determined from the table of FIG. 12 based on the password and ID entered by the operator. Only when the operator has the unlocking authority, the operator can unlock the corresponding lock (any of the first lock, the second lock, and the third lock).

Next, the deposit process will be described. Referring to FIG. 5, when the customer operates the customer service part and the medium is inserted to the input pocket 21 provided at a height where both a healthy person and a disabled person using a wheelchair can comfortably insert the medium, the medium is transferred to the transport path 412. After the medium is transported downward, the medium is transported horizontally backward. As a result, the medium is sent from the front to the rear of the automated teller machine 1 across the wall. Further, since the media recognizer 25 is provided in the transport route, the medium is recognized by the media recognizer 25, and the recognized medium is passed through the transport paths to the temporary storage 24 or storage divisions 31, 32, 33, 34, 35, and 36 provided in the safe 13 to be stored.

Next, the withdrawal process will be described. The customer operates the customer screen 101, and the specified amount of the media is sent from the storage divisions 31, 32, 33, 34, 35, and 36 to the discharge pocket 22 via the transporter. Here, the transport route of the medium when the customer forgets to take the medium discharged to the discharge pocket 22 will be described. There are two transport routes, and it is possible to select either one.

Figure 14:
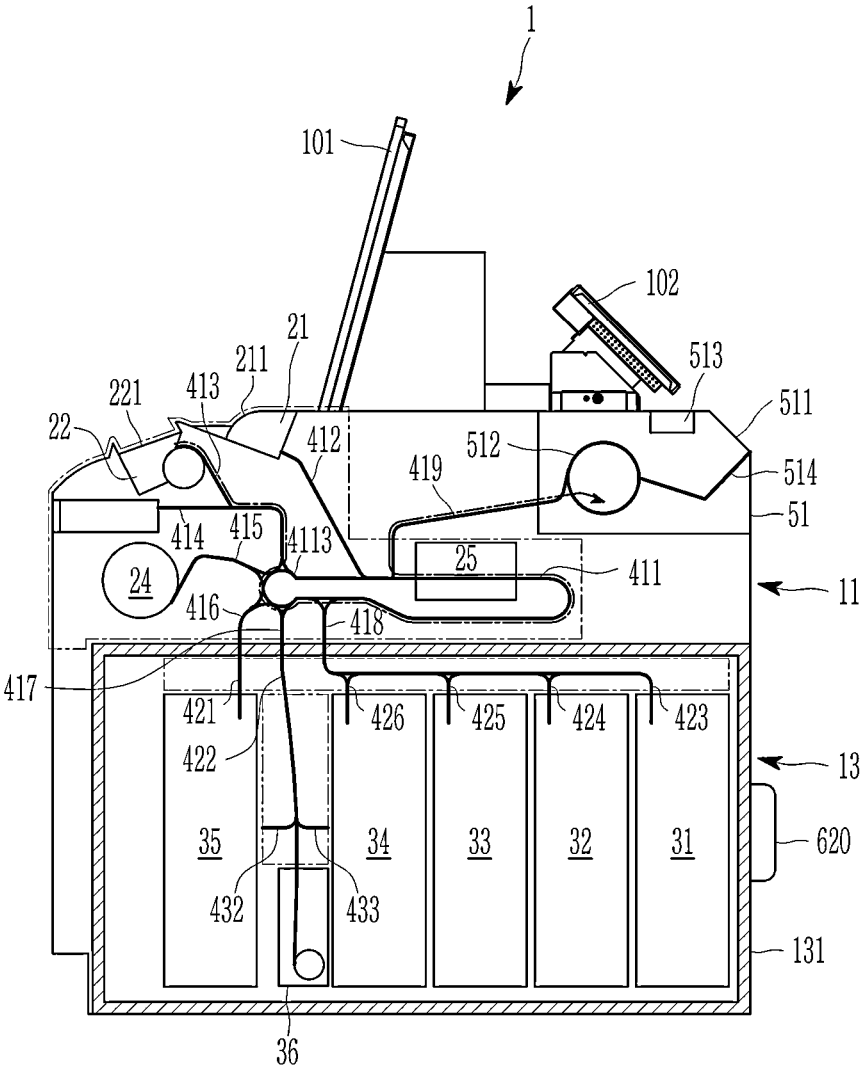
FIG. 14 is a schematic diagram showing an example path of a forgotten medium, passing through a transporter and an identification unit, until collected.

The first transport route is a route in which the forgotten medium passes through the media recognizer 25, and reaches the collector 51 as shown in FIG. 14 as the dashed line. This transport route makes it possible to reconfirm the denomination and number of media that have been forgotten. It is also possible to deal with the case where only a portion of the media discharged to the discharge pocket 22 is forgotten and left behind.

Figure 15:
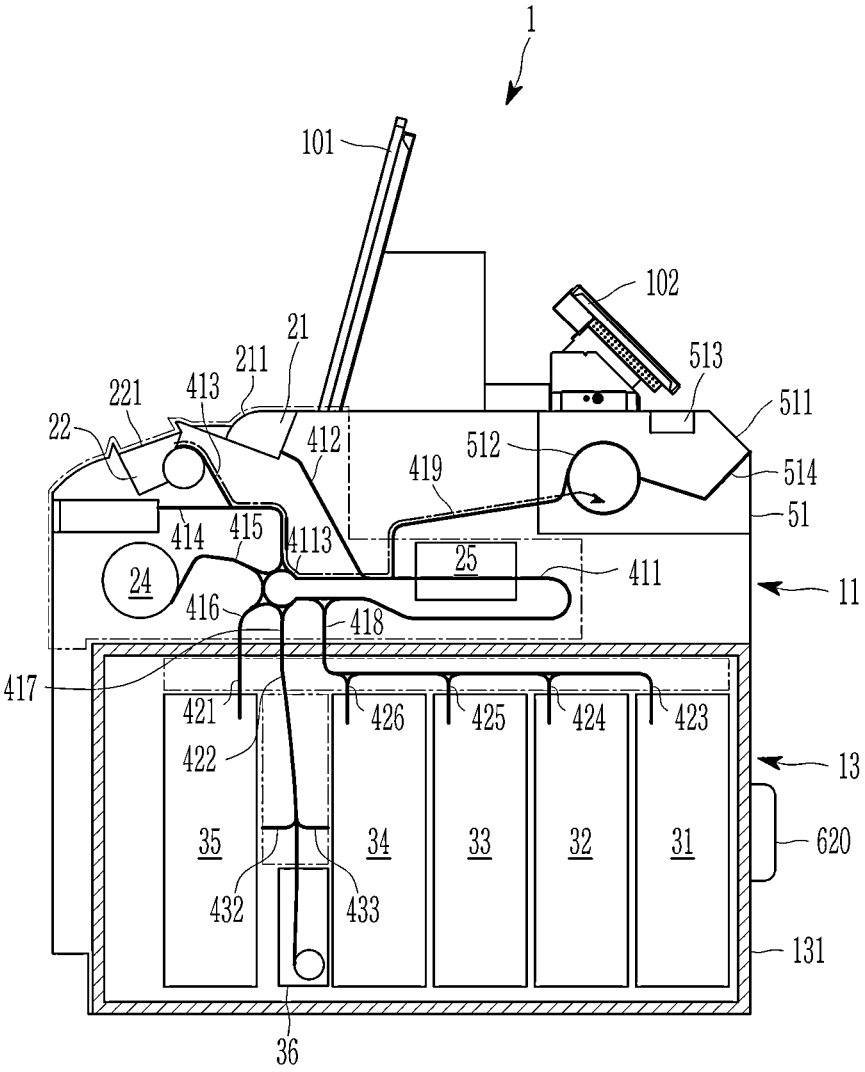
FIG. 15 is a schematic diagram showing an example path of a forgotten medium, passing through the transporter but not passing through the identification unit, until collected.

The second transport route is a route in which the forgotten medium reaches the collector 51 without passing through the media recognizer 25 as shown in FIG. 15 as the dashed line. Since the transport route is shortened by not passing through the media recognizer 25, the processing time is reduced, and the occurrence of errors such as jam during transport is suppressed.

If an institution clerk having authority selects one of the routes to collect the forgotten medium in the settings, collection will be executed by the set route. It is also possible that after determining whether the media in the discharge pocket 22 are partially extracted or not, a route is selected. For example, a rout that does not pass through the media recognizer 25 is selected if there is no partial extraction. For example, a route that passes through the media recognizer 25 is selected if there is a possibility of partial extraction. This makes it possible to select a transport route according to the situation.

In the first embodiment described above, the customer service part and the institution clerk part are separated by a wall, but in the second embodiment which will be described below, the automated teller machine 1 is installed in an island shape in a lobby of a financial institution such as a bank without the wall separation.

When installing the automated teller machine 1 in an island shape, a door or a shutter 511 is required in the collector 51. A lock is provided on the shutter 511 of the collector 51. The lock may be unlocked by inputting a unlock command on the clerk screen 102 like in the first embodiment. Further, the unlock command may be input from an external personal computer or the like. Thereby, the lock can be unlocked without directly operating the clerk screen 102 of the automated teller machine 1. Further, the lock may be automatically released during the process of error release or maintenance work, or a mechanism for unlocking with a key may be applied. As described in the first embodiment, the authority for unlocking the shutter 511 of the collector 51, the upper unit 11, and the safe door 131 of the lower unit may be given to limited persons in a various combinations. As a result, it is possible to prevent the medium from being illegally taken away by a customer. Further, as described the first embodiment, since the clerk screen 102 is provided on the rear part of the automated teller machine 1, a clerk may operate the clerk screen 102 while the customer operates the customer screen 101.

The lock of the shutter 511 of the collector 51 is different from that of the upper unit and the lower unit of the automated teller machine 1 as described in the first embodiment, and the shutter 511 of the collector 51 may be unlocked independently. As a result, when collecting media that have been forgotten to take, only the shutter 511 of the collector 51 needs to be unlocked and unlocking others such as the safe door is not required so that the work can be performed promptly and security is enhanced.

customer service part
customer screen 101
institution clerk part
clerk screen 102
input pocket 21
discharge pocket 22
rejection pocket 23
collector 51
collection pocket 514
impeller 512
shutter 511
pulling handle 610
lever 620
safe door 131
safe 13
transport paths 411, 412, 413, 414, 415, 416, 417, 418, 419, 4113, 421, 422, 423, 431, 432, and 433
circulation pass 411
media recognizer 25
temporary storage 24
storage divisions 31, 32, 33, 34, 35, and 36
upper unit 11
lower unit

What is claimed is:

1. An automatic teller machine comprising:

a customer service part configured to receive customer operations;

an input pocket provided in the customer service part and configured to receive a medium input by a customer;

a media recognizer configured to recognize the medium received by the input pocket;

a first storage storing the medium recognized by the media recognizer;

a discharge pocket provided in the customer service part and configured to discharge the medium to an outside of the automatic teller machine;

a first transport path that connects the input pocket, the media recognizer, the first storage, and the discharge pocket to transport the medium;

a second storage storing a collected medium, wherein the collected medium is the medium forgotten to be taken out from the discharge pocket by the customer;

a second transport path connecting the second storage to the first transport path; and a second lock, wherein the second storage is arranged above the first transport paths and on an opposite side of the customer service part and the second storage has an opening facing up side or rear side which is opposite side to the customer service part and comprises a shutter to close the opening and a first lock to prevent the shutter from opening, wherein an upper unit is partitioned to comprise the media recognizer, at least one part of the first transport path, and the second storage, and the upper unit is configured to be pulled out to the rear side, wherein the second lock prevents the upper unit from being pulled out to the rear side in a locked state, wherein the second lock and the first lock are independently operated, wherein, in a state that the upper unit is not pulled out to the rear side, the first lock is capable of being unlocked to allow the shutter open and the collected medium being taken out from the second storage, and wherein, in a state that the upper unit is pulled out to the rear side, the first lock is capable of being locked to prevent the shutter from opening.

2. The automatic teller machine of claim 1, wherein the first transport path comprises a third transport path arranged horizontally, and the second storage is arranged above the third transport path.

3. The automatic teller machine of claim 1, wherein the second transport path branches upward from the first transport path.

4. The automatic teller machine of claim 1, wherein the second transport path branches upward from between the discharge pocket and the media recognizer of the first transport path.

5. The automatic teller machine of claim 1, wherein the second storage is located at a place conforming to the American with Disabilities Act (ADA).

6. The automatic teller machine of claim 1, wherein the first transport path and the second transport path form a transport route from the discharge pocket to the second storage via the media recognizer to transport the collected medium.

7. The automatic teller machine of claim 1, wherein the first transport path comprises a circulation path passing through the media recognizer, and each of the input pocket, the discharge pocket, and the second storage is connected to respective branch paths branched out from the circulation path.

8. The automatic teller machine of claim 1, further comprising an operation unit to unlock the first lock.

9. The automatic teller machine of claim 8, wherein the operation unit is provided on a rear surface of the automatic teller machine, which is the opposite side of the customer service part.

10. The automatic teller machine of claim 1, further comprising an interface to input a command to unlock the first lock.

11. The automatic teller machine of claim 1, further comprising a third lock to prevent the first storage from pulled out to the rear side, and wherein the first lock, the second lock, and the third lock are independently operated.

12. An automatic teller machine comprising:

a customer service part configured to receive customer operations;

an input pocket provided in the customer service part and configured to receive a medium input by a customer;

a media recognizer configured to recognize the medium received by the input pocket;

a first storage storing the medium recognized by the media recognizer;

a discharge pocket provided in the customer service part and configured to discharge the medium to an outside of the automatic teller machine;

a first transport path that connects the input pocket, the media recognizer, the first storage, and the discharge pocket to transport the medium;

a second storage storing a collected medium, wherein the collected medium is the medium forgotten to be taken out from the discharge pocket by the customer;

a second transport path connecting the second storage to the first transport path; and a selector, wherein the second storage is arranged above the first transport paths and on an opposite side of the customer service part, wherein the first transport path and the second transport path form a first transport route from the discharge pocket to the second storage via the media recognizer to transport the collected medium and a second transport route from the discharge pocket to the second storage without via the media recognizer to transport the collected medium, and wherein the selector selects one of the first transport route and the second transport route.

13. The automatic teller machine of claim 12, wherein the selector selects one of the first transport route and the second transport route depending on whether the medium is partially extracted from the discharge pocket or not.

14. The automatic teller machine of claim 12, wherein when the medium is partially extracted from the discharge pocket, the selector selects the first transport route and, when the medium is not extracted from the discharge pocket at all, the selector selects the second transport route.

* * * * *